US005520556A

United States Patent [19]

Endo et al.

[11] Patent Number: 5,520,556

[45] Date of Patent: May 28, 1996

[54] FEMALE TERMINAL

[75] Inventors: Takayoshi Endo; Takashi Ishii, both of Shizuoka-ken, Japan

[73] Assignee: Yazaki Corporation, Japan

[21] Appl. No.: 345,801

[22] Filed: Nov. 22, 1994

Related U.S. Application Data

[63] Continuation of Ser. No. 149,744, Nov. 10, 1993, abandoned.

[30] Foreign Application Priority Data

Nov. 12, 1992 [JP] Japan ..... 4-302337

[51] Int. Cl.[6] ..... H01R 13/187

[52] U.S. Cl. ..... 439/845

[58] Field of Search ..... 439/843–847, 439/851–853, 858, 861

[56] References Cited

U.S. PATENT DOCUMENTS

| | | | |
|---|---|---|---|
| 3,370,265 | 2/1968 | Berg | 439/843 |
| 4,560,231 | 12/1985 | Shirai | 439/843 |
| 4,648,673 | 3/1987 | Endo et al. | 439/395 |
| 5,158,485 | 10/1992 | Saito et al. | 439/843 |
| 5,217,382 | 6/1993 | Sparks | 439/843 |
| 5,226,842 | 7/1993 | Endo et al. | 439/843 |

FOREIGN PATENT DOCUMENTS 59-84773 6/1984 Japan .

*Primary Examiner*—Gary F. Paumen

*Attorney, Agent, or Firm*—Wigman, Cohen, Leitner & Myers

[57] ABSTRACT

A female terminal comprises: a square cylindrical electric contact portion (2) having an opening (2*a*) into which a male terminal is inserted: an elastic contact piece (3) housed in the electric contact portion and brought into elastic contact with the inserted male terminal, the elastic contact piece being formed with two side lug portions (10); and at least one supporting portion (14) formed on at least one of side walls of the electric contact portion, for supporting at least one of the lug portions formed in the elastic contact piece. For prevention of the elastic contact piece (3) from being dislocated from the supporting portion (14) without increasing the external size of the female terminal, in particular, the supporting portion (14) is elastically bent inwardly from the side wall (7) of the electric contact portion (2).

3 Claims, 2 Drawing Sheets

FEMALE TERMINAL

This is a continuation of application Ser. No. 08/149,744 filed on Nov. 10, 1993, now abandoned.

BACKGROUND OF THE INVENTION

1. Field of the Invention

The present invention relates to a female terminal provided with an elastic contact piece within a square cylindrical electric contact portion.

2. Description of the Related Art

An example of the female terminal is disclosed in Japanese Published Unexamined Utility Model Application No. 59-84773. This prior art female terminal is composed of a terminal member formed with an electric contact portion and a wire fastening portion, and an elastic contact piece. The electric contact portion is formed into a square cylindrical shape having an opening into which a mated male terminal is inserted and another opening extending to the wire fastening portion. The elastic contact piece is movably housed within the electric contact portion.

The electric contact portion is formed with a base plate, an opposing plate and both side walls for connecting the base plate and the opposing plate. The middle part of the base plate is cut open so as to form two groove portions extending to a predetermined depth in both the side walls of the electric contact portion. The two grooves formed in the side walls serve as two elastic contact piece support portions for supporting both side ends of the elastic contact piece. In more detail, the elastic contact piece is bent inwardly toward the opposing plate along the longitudinal direction thereof, and further formed with two lug portions at roughly the middle portion thereof so as to be supported by the two groove portions. Therefore, the elastic contact piece is movably housed in the electric contact portion under such conditions that both longitudinal ends of the elastic contact piece are in contact with the inner surfaces of the base plate and further both the lug portions are in contact with two open surfaces in the two grooves in such a way as to be projected from the grooves, respectively. In other words, the elastic contact piece is supported by the elastic contact piece supporting portions in such a way that the longitudinal movement of the elastic contact piece is restricted by the two grooves formed in the two side walls and further the transverse movement thereof is restricted by the two side walls of the electric contact portions.

Therefore, when the male terminal is inserted into the electric contact portion of the female terminal, the elastic contact piece is deformed extending in the longitudinal direction to apply an appropriate contact pressure to the male terminal on the basis of the restitutive force of the elastic contact piece. Accordingly, the male terminal can be supported between the opposing plate and the elastic contact piece to connect both male and female terminals under appropriate mechanical and electrical contact conditions.

In the above-mentioned female terminal, however, the inner and outer dimensions thereof are usually strictly restricted on the basis of the shape and dimensions of the male terminal or according to the terminal mounting positions, it is necessary to reduce the dimension in the width direction of the female terminal as much as possible. In other words, it is not preferable to form the lug portions in such a way as to project sufficiently outside from the two side walls or to increase the wall thickness of the elastic contact piece. However, when the lug portions are reduced in shape, there exists a problem in that whenever the elastic contact portion is moved slightly in the width direction, any one of the lug portions is dislocated from the elastic contact piece supporting portion toward the opposing plate, so that the elastic contact piece is supported obliquely within the electric contact portion.

In case the lug portion of the elastic contact piece is dislocated from the elastic contact piece supporting portion and thereby inclined, since the male terminal cannot be inserted into the female terminal by the presence of the inclined elastic contact piece, the terminal work is complicated and thereby the terminal workability is deteriorated. In addition, when the male terminal is inserted under the condition that the elastic contact piece is inclined, since the male terminal is brought into contact with the inclined elastic contact piece, an appropriate contact force and a sufficient contact surface cannot be both obtained, thus deteriorating the electric contact condition between both the male and female terminals.

SUMMARY OF THE INVENTION

With these problems in mind, therefore, it is the object of the present invention to provide a female terminal which can prevent the elastic contact piece from being dislocated from the supporting portion, facilitate the insertion of the male terminal into the female terminal, and thus realize a stable connection between both the male and female terminals.

To achieve the above-mentioned object, the present invention provides a female terminal comprising: a square cylindrical electric contact portion having an opening into which a male terminal is inserted: an elastic contact piece housed in said electric contact portion and brought into elastic contact with the inserted male terminal, said elastic contact piece being formed with two side lug portions on both sides thereof; and at least one supporting portion formed in at least one of side walls of said electric contact portion In such a way as to be elastically bent inwardly over the side wall of said electric contact portion, for supporting at least one of the lug portions formed in said elastic contact piece.

Further, it is also preferable to form the supporting portion on each of the side walls of said electric contact portion. The supporting portion is preferably formed by making a single slit or two slits at an interval in the side wall of said electric contact portion. The supporting portion is bent inwardly into a convex or circular arc-shaped curvature by a distance larger than a thickness of the side wall of said electric contact portion.

In the female terminal according to the present invention, since the supporting portion Is elastically bent inwardly over the side wall of the electric contact portion, the width for supporting the elastic contact piece can be increased by the distance projecting inward from the side wall of the electric contact portion. Therefore, even when the elastic contact piece is moved In the width direction, it is possible to prevent the lug portion of the elastic contact piece from being dislocated from the supporting portion of the electric contact portion. In addition, when the male terminal is mated with the female terminal, since the supporting portions are deformed outwardly, it Is possible to hold the male terminal securely by the elastic engaging force of the supporting portions of the electric contact portion.

With the foregoing and other objects, advantages, and features of the invention that will become hereinafter apparent, the nature of the invention may be more clearly understood by reference to the following detailed description of the invention, the appended claims, and the various views illustrated by the drawings.

BRIEF DESCRIPTION OF THE DRAWINGS

FIGS. 3A and 3B are cross-sectional views, taken along the line III—III shown in FIG. 2, in which FIG. 3A shows the status where a male terminal is not yet inserted, and FIG. 3B shows the status where the male terminal has been inserted.

DETAILED DESCRIPTION OF THE PREFERRED EMBODIMENTS

One embodiment of the female terminal according to the present invention will be described hereinbelow with reference to the attached drawings.

Figure 1:
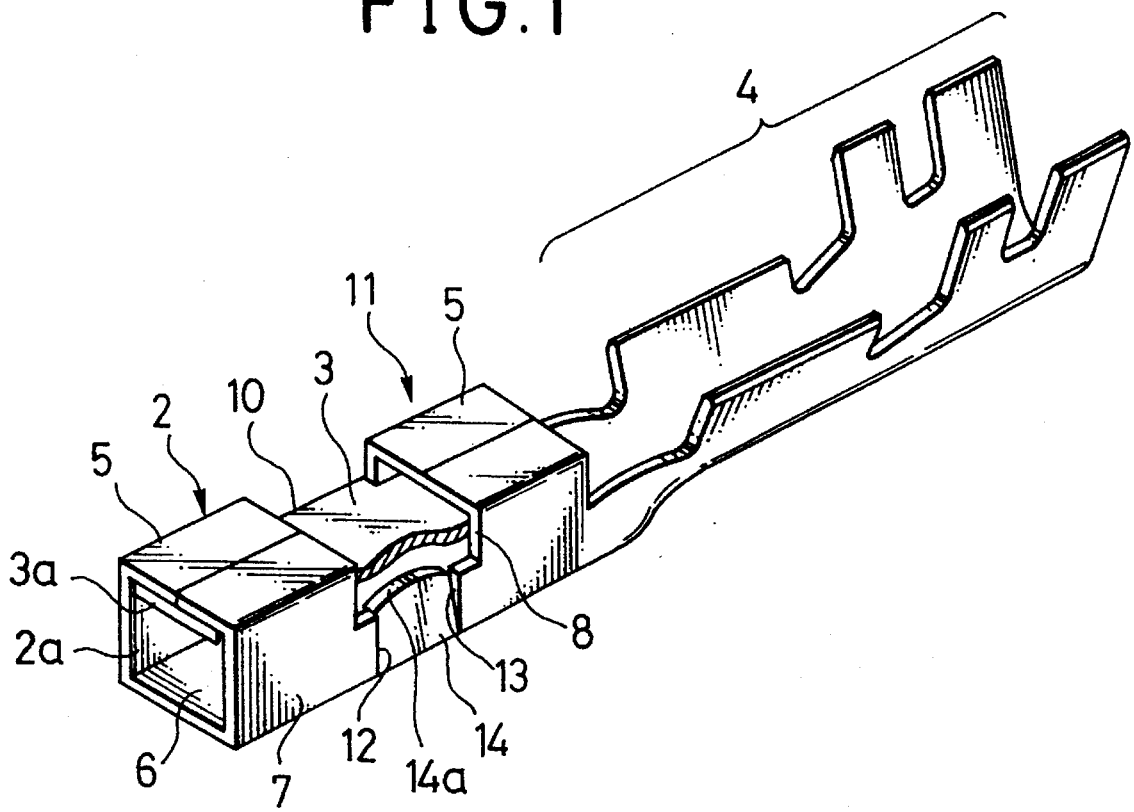
FIG. 1 is a perspective view showing one embodiment of the female terminal according to the present invention.
Figure 2:
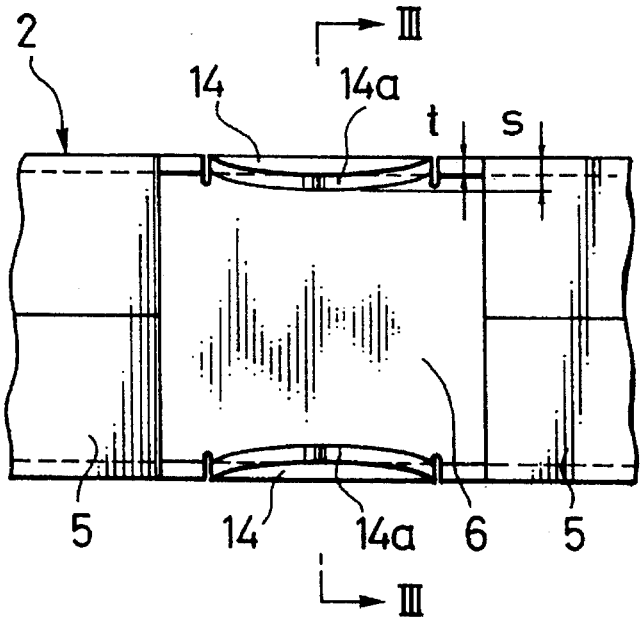
FIG. 2 is an enlarged plane view showing the same female terminal shown In FIG. 1.

In FIGS. 1 and 2, the female terminal is composed of a terminal member 11 formed with an electric contact portion 2 and a wire fastening portion 4, and an elastic contact piece 3. The electric contact portion 2 is formed into a square cylindrical shape having an opening 2*a* into which a mated male terminal (not shown) is inserted and another opening extending to the wire fastening portion 4. The elastic contact piece 3 is movably housed within the electric contact portion 2.

The electric contact portion 2 is formed with a base plate 5, an opposing plate 6 and both side walls 7 for connecting the base plate 5 and the opposing plate 6. The middle part of the base plate 5 is cut open so as to form two groove portions 8 extending to a predetermined depth in both the side walls 7 of the electric contact portion 2.

Figure 3A:
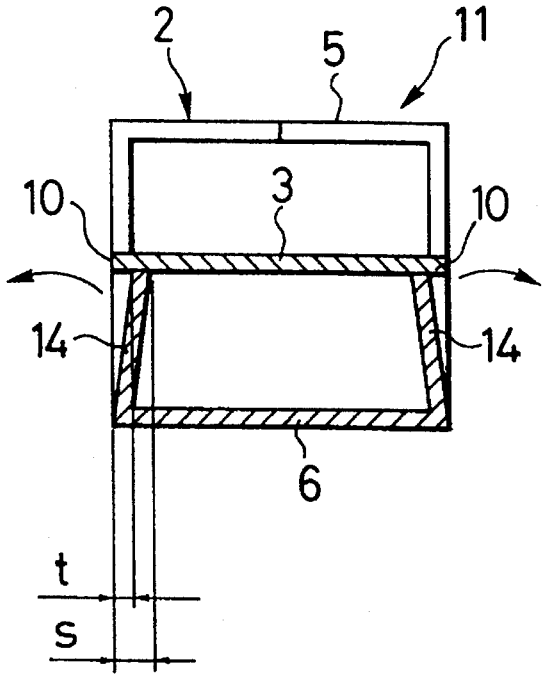

Further, two slits 12 and 18 are formed at a predetermined interval by cutting each of the two side walls 7 so as to extend from each groove portion 8 to the opposing plate 6. Each of the two side wall 7 is bent elastically inward of the electric contact portion 2 into a a convex or circular arc shape (as shown in FIG. 2) at each open end surface 14*a* and between the two slits 12 and 13. That is, each side wall 7 formed between the two slits 12 and 13 constitutes an elastic contact piece supporting portions (referred to a supporting portion, hereinafter) 14, respectively. Here, the inward-bent dimension s of the circular arc-shaped open end surface 14*a* of the supporting portion 14 is determined to be larger (s>t) than the thickness t of the side wall 7, as shown in FIG. 2 and 3A.

On the other hand, the elastic contact piece 3 is formed with two lug portions 10 at roughly the middle portion thereof so as to be supported by the two supporting portions 14 formed between the two slits 12 and 13 on the side walls 7 of the electric contact portion 2, respectively. Therefore, the elastic contact piece 3 can be housed in the electric contact portion 2 under such a condition that two longitudinal end surfaces of the two lug portions 10 formed in the elastic contact piece 3 are in contact with two open surfaces of the grooves 8, respectively and further the two inner flat surfaces of the two lug portions 10 are supported by the supporting portions 14 formed between the two slits 12 and 13 of the side walls 7. In other words, the elastic contact piece 3 can be supported by the supporting portion 14 in such a way that the longitudinal movement of the elastic contact piece 3 is restricted in the two grooves 8 formed in the two side walls 7 and the transverse movement thereof is restricted by the two open end surfaces 14*a* of the supporting portions 14.

In this embodiment, since the elastic contact piece 3 can be supported by the open end surface 14*a* of the supporting portions 14 inwardly bent by a distance s larger than the plate thickness t of the side walls 7 of the electric contact portion 2, it is possible to support the elastic contact piece 3 more securely by the supporting portion 14, as compared with the prior art by which the elastic contact piece 3 is supported by the end surface (i.e., the plate thickness t) of the supporting portion.

Therefore, when the male terminal (not shown) is inserted into the electric contact portion 2 of the female terminal, since the elastic contact piece 3 can be securely supported by the supporting portions 14, it is possible to insert the male terminal Into the female terminal smoothly without being obstructed by the presence of the elastic contact piece 3, so that the insertion workability of the male terminal into the female terminal can be improved. Further, since the supporting portions 14 are formed into a a convex or circular arc-shape curvature, it is possible to insert the male terminal into the electric contact portion 2 of the female terminal smoothly, without being caught by the inwardly bent supporting portions 14 with an elastic engagement therebetween. Further, since the inserted male terminal can be brought into pressure contact with the elastic contact piece 3 under an appropriate contact pressure and over an appropriate contact surface, it is possible to stabilize the mechanical and electrical contact between the two male and female terminals, thus improving the reliability of the two mated terminals.

Figure 3B:
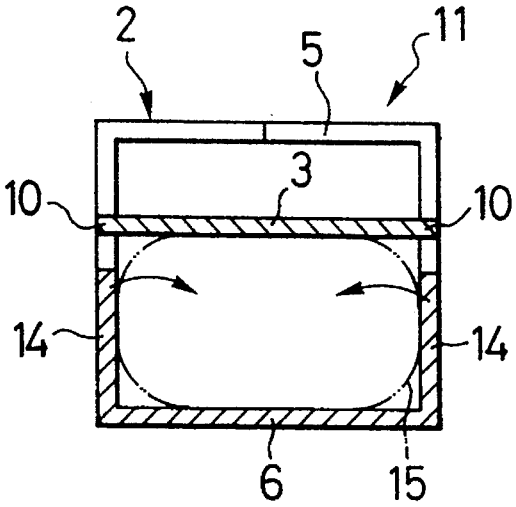

Further, as shown in FIG. 3B, after the male terminal has been inserted into the electric contact portion 2 of the female terminal, since the elastic contact piece 3 and the supporting portions 14 are all deformed outwardly, it is possible to apply the restitutive forces of the elastic contact piece 3 and the two supporting portions 14 to the male terminal. That is, since the male terminal can be supported by the female terminal from two different directions, the male and female terminals can be coupled to each other more securely under both mechanical and electrical conditions. In addition, since the supporting portions 14 are formed by bending the side walls 7 inwardly, it is possible to prevent the elastic contact piece 3 from being dislocated from the supporting portions 14, without increasing the dimensions or size of the electric contact portion 2.

Figure 4:
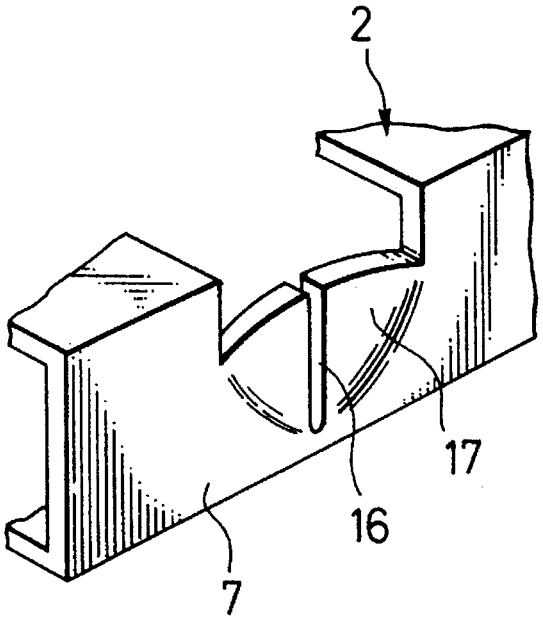
FIG. 4 is an enlarged perspective view showing an essential portion of another embodiment of the female terminal according to the present invention.

Further, without being limited to only the above-mentioned embodiment, the female terminal according to the present invention can be modified in various ways. For instance, the same effect as above can be obtained when the supporting portion 14 is formed on only one side of the side walls 7. Further, as shown in FIG. 4, two supporting portions 17 can be formed by making a single slit 16 in the side wall 7 at roughly the middle position in the longitudinal direction of the groove formed in the electric contact portion 2. In this case, the supporting portions 17 formed on both sides of the slit 16 are both bent inwardly into circular arc-shaped curvature, respectively.

As described above, in the female terminal according to the present invention, since the electric contact piece can be prevented from belong dislocated from the supporting portions of the electric contact portion of the female terminal, without increasing the size of the electric contact portion, it is possible to facilitate the insertion of the male terminal into the female terminal under stable coupling conditions between the two fittings.

What is claimed is:

1. A female terminal for receiving and coupling with a male terminal, the female terminal comprising:

an electric contact portion having an opening into which the male terminal is inserted;

an elastic contact piece housed in said electric contact portion and brought into elastic contact with the inserted male terminal, said elastic contact piece being formed with two side lug portions on both sides thereof; and a supporting portion formed in a side wall of said electric contact portion, said supporting portion having a top edge for supporting one said lug portion and a single slit extending from substantially the center of said top edge toward a bottom wall of said electric contact portion, said supporting portion being elastically bent inwardly from the side wall of said electric contact portion into a substantially circular arc shape at the said top edge of said supporting portion;

wherein said supporting portion slidably receives and supports with an elastic engagement the male terminal at said top edge; and wherein said supporting portion supports a corresponding lug portion when the male terminal has been removed from the female terminal.

2. The female terminal of claim 1, wherein said supporting portion is bent inwardly by a distance larger than a thickness of the side wall of said electric contact portion.

3. The female terminal of claim 1, wherein said supporting portion is bounded by a pair of groove portions formed in said electric contact portion and said slit bifurcates said top edge of said supporting portion at a median thereof, said slit extending perpendicular from said top edge and wherein said supporting portion is elastically contract portion.

* * * * *